US012290113B1

(12) United States Patent
Swezey

(10) Patent No.: US 12,290,113 B1
(45) Date of Patent: May 6, 2025

(54) ADJUSTABLE UNDERGARMENT

(71) Applicant: Eric Swezey, Billerica, MA (US)

(72) Inventor: Eric Swezey, Billerica, MA (US)

( * ) Notice: Subject to any disclaimer, the term of this patent is extended or adjusted under 35 U.S.C. 154(b) by 0 days.

(21) Appl. No.: 18/932,841

(22) Filed: Oct. 31, 2024

Related U.S. Application Data

(60) Provisional application No. 63/594,978, filed on Nov. 1, 2023.

(51) Int. Cl.
*A41B 9/02* (2006.01)

(52) U.S. Cl.
CPC ..... *A41B 9/02* (2013.01)

(58) Field of Classification Search
CPC ..... A41B 9/02
See application file for complete search history.

(56) References Cited

U.S. PATENT DOCUMENTS

| | | | | |
|---|---|---|---|---|
| 1,477,187 | A | 12/1923 | Rayne | |
| 1,592,732 | A | 7/1926 | Friedman | |
| 1,840,621 | A | 1/1930 | Dwyer | |
| 3,207,155 | A | 9/1965 | Casey | |
| 3,494,361 | A * | 2/1970 | Thivat | A61F 13/66 604/401 |
| 6,622,719 | B1 | 9/2003 | Slautterback et al. | |
| 6,820,284 | B2 * | 11/2004 | Horikoshi | A41B 9/023 2/403 |
| 8,763,165 | B2 | 7/2014 | Soderstrom | |
| 9,375,035 | B1 | 6/2016 | Ingels | |
| 10,085,492 | B2 | 10/2018 | Polidan et al. | |
| 10,512,288 | B2 | 12/2019 | Campbell, Jr. | |
| 11,918,056 | B2 | 3/2024 | Shaugnessy et al. | |
| 2005/0177931 | A1 | 8/2005 | Tsujimoto | |
| 2005/0268380 | A1 | 12/2005 | Sovell | |
| 2007/0044209 | A1 | 3/2007 | Maurer | |
| 2007/0192941 | A1 * | 8/2007 | Soderstrom | A41B 9/02 2/403 |
| 2007/0245463 | A1 | 10/2007 | Kang | |
| 2010/0275349 | A1 | 11/2010 | Wilson, II | |
| 2014/0331390 | A1 * | 11/2014 | Matsumoto | A41B 9/023 2/403 |
| 2015/0209657 | A1 | 7/2015 | MacFarland | |
| 2015/0231482 | A1 | 8/2015 | Ziehler et al. | |
| 2017/0290375 | A1 | 10/2017 | Walker | |
| 2019/0090552 | A1 | 3/2019 | Crump | |
| 2020/0008495 | A1 | 1/2020 | Anderson | |
| 2022/0378116 | A1 | 12/2022 | Morris, V et al. | |

* cited by examiner

*Primary Examiner* — Khaled Annis
(74) *Attorney, Agent, or Firm* — Bay State IP, LLC

(57) ABSTRACT

The present disclosure is an adjustable undergarment with support pouch that is formed by a support panel located in a front panel of an inner liner of the adjustable undergarment. Furthermore, the front panel includes a pair of bungee cords on the left and right, and toggles at the upper end of each cord which are positioned laterally to the support pouch, and the first end of each cord is secured to the support pouch. Tightening and loosening the bungee cords allows for adjustments of the support pouch ranging from a relaxed state to a tensioned state.

11 Claims, 18 Drawing Sheets

ADJUSTABLE UNDERGARMENT

CROSS REFERENCE TO RELATED APPLICATION

This application claims the benefit of and takes priority from U.S. Provisional Patent Application Ser. No. 63/594,978, filed on Nov. 1, 2023, the contents of which are herein incorporated by reference.

BACKGROUND OF THE INVENTION

Field of the Invention

The present disclosure relates generally to the field of adjustable undergarments, and more particularly to athletic shorts with an adjustable support pouch to allow a user to exercise while avoiding chaffing through adjustment of the support pouch.

Description of the Related Art

Men's underwear are garments of clothing that are typically worn underneath outer clothing and has direct contact with skin and male genital areas. Men's underwear is useful to stop direct contact with skin and coarser outer layers. Many kinds of men's underwear are available, including boxers, boxer briefs and regular briefs.

Compression shorts are utilized as undergarments for men and women to prevent chaffing of the thighs, typically during exercise. Furthermore, compression shorts are used to contain, in several ways. For instance, compression shorts are typically made out of elastic fibers and materials, such as polyester, in order to contract on a user's waist and thighs, in order to prevent shifting and movement of the undergarment.

While compression shorts accommodate the shifting, moving, and bunching of boxers, boxer briefs, and regular briefs, they do not provide a pouch that provides extra surface area and volume to male users, in order to comfortably contain their male genitalia. Instead, compression shorts hold down male genitalia and uncomfortably press a user's male genitalia against a user's body or in between a user's legs, in order to prevent movement.

There is also a kind of underwear that creates a forward-facing pouch that receives the genitals, called anatomical underwear. Anatomical underwear separates the genitals from touching the thighs, but creates several inadequacies in doing so, including but not limited to; lack of support for the genitals from movement, genitals pushed into the perineum area, seams that rest against the groin/genitalia and conforming the pouch that is able to fit different shapes and sizes.

SUMMARY OF THE INVENTION

The instant apparatus, as illustrated herein, is clearly not anticipated, rendered obvious, or even present in any of the prior art mechanisms, either alone or in any combination thereof. A versatile apparatus for supplying comfort and containing properties to male genitalia during exercise as well as everyday use is disclosed.

A primary object of the present disclosure is to provide an adjustable undergarment that provide for a seamless and adjustable support pouch to receive male genitals which includes a toggle support system to enable the user to change the firmness and snugness of the support pouch and in turn decreasing movement of the genitalia during exercise. The support pouch may be located near or in a central on a front panel of an inner liner of the adjustable undergarment, wherein support pouch is preferably forms by an origami-like fold in the front panel to encapsulate the genitals. In one embodiment, the support pouch may be formed by an extra piece of material of the front panel being folded up at a point near a groin of the user and then secured by a stitch or similar securing mechanism near a waistband of the adjustment undergarment which creates the support pouch free of seams. In one embodiment, the front of the adjustable undergarment is comprised of a single piece of fabric, however in alternate embodiments, more than one piece of fabric may be utilized during creation. In another embodiment, a bungee and toggle system allows for the adjustment of the support pouch in an upward or downward direction relative to the waistband depending on the user's desired snugness of the genitals while using the adjustable undergarment. In one embodiment, a pair of bungees placed on opposing sides of the support pouch and each connected to the corresponding side of the support pouch preferably at an anchor located near or substantially near a button of the support pouch. A toggle may be provided at the opposing end of each bungee to allow for easy adjustment of the support pouch and held in place by an upper anchor point.

Therefore, it is the intention of this disclosure to introduce an adjustable undergarment with a preferably centrally located and seamless adjustable support pouch to secure a user's genitals. This disclosure preferably provides a support pouch that is free of seams and located within an inner liner of the adjustable undergarment to enable the user to adjust the level of support and shape of the pouch to fit the user and restrict rebound of the genitalia during movement. In one embodiment, the support pouch may be created by utilizing a single piece of fabric from the front panel, wherein the fabric is tucked, folded and secured around the genitals of the user. In this embodiment, the fold to create the support pouch is held in place by a stitch or similar securing mechanism located substantially horizontally above the support pouch. Preferably, the support pouch is adjusted upwardly or downwardly by a pair of bungee strings, connected on each side of the support at an anchor point located near or at the bottom of the support pouch. In this embodiment, the anchor points may be double stitched into the front panel, and a toggle is preferably located an end of each bungee at the anchor near the waistband to enable the cords to be engaged or disengaged by the user. In the embodiment of when the pair of bungees are engaged by the user, the support pouch may be adjusted to the user's needs, thereby supporting and reducing movement of the genitals for the current use of the adjustable undergarment. Therefore, when utilized with an outer shell, the toggles may be placed in the pockets of the outer shell to enable discreet adjustments in one embodiment.

There has thus been outlined, rather broadly, the more important features of an adjustable undergarment, in order that the detailed description thereof that follows may be better understood, and in order that the present contribution to the art may be better appreciated. There are additional features of the system that will be described hereinafter and which will form the subject matter of the claims appended hereto.

In this respect, before explaining at least one embodiment of the device in detail, it is to be understood that the system is not limited in its application to the details of construction and to the arrangements of the components set forth in the following description, and/or illustrated in the drawings. The system is capable of other embodiments and of being practiced and carried out in various ways. Also, it is to be understood that the phraseology and terminology employed herein are for the purpose of description and should not be regarded as limiting.

These together with other objects of the device, along with the various features of novelty, which characterize the system, are pointed out with particularity in the claims annexed to and forming a part of this disclosure. For a better understanding of the system, its operating advantages and the specific objects attained by its uses, reference should be made to the accompanying drawings and descriptive matter in which there are illustrated preferred embodiments of the device.

The foregoing has outlined the more pertinent and important features of the present device in order that the detailed description of the system that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

BRIEF DESCRIPTION OF THE DRAWINGS

Many aspects of this invention are better understood by referencing the following drawings. The drawings are not to scale, but emphasis has been placed on showing the principles of the invention. There are multiple views of the invention and therefore like numerals identify corresponding parts through multiple views. Although one way is depicted in the following drawings, there are many ways to accomplish the goal of having an adjustable support system for the genitalia, and those methods should also be considered within scope of this claim.

DETAILED DESCRIPTION OF THE SEVERAL EMBODIMENTS

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Various types of undergarments, specifically boxers, briefs, and boxer briefs, do not accommodate male genitalia during exercise because they are not made out of athletic fibers such as polyester that expand and contract while holding a user's genitalia in place. Further, compression shorts do not contain an extra area where a male's genitalia can comfortable be supported without being pressed against a user's thighs. Proper accommodation may require a pouch, suitable to all size genitalia, that blocks a user's genitals from chaffing against a user's thighs, while supporting a male's genitalia comfortably, without seams that cause painful friction. The present solution implements an adjustable pouch that does not include seams and enables a user to exercise without chaffing, resulting in accommodating comfort, support, and satisfaction.

It will be appreciated that the present solution may thus be utilized while a user participates in various exercises, including but not limited to jumping, lifting, running, swimming, walking, without discomfort or inadequate support. For example, many undergarments do not allow a user to utilize a single piece of clothing that contains, protects, and supports their genitalia; the present solution can compensate for any size male genitalia by providing pull tabs attached to strings on the pouch that contract the size of the pouch when the tabs are pulled. Further, when the tabs are released, the strings attached to the pouch release and provide slack, that expands the size of the pouch. In addition, it will be appreciated that such improvements are enabled by the present solution while being attached to an outer shell shorts layer that serves as a cover to the undergarments. The outer shell shorts layer is stitched on top of the undergarment-pouch housing layer, allowing for a user to slip the shorts on in one motion without having to separately put on the undergarments and athletic shorts.

Figure 1:
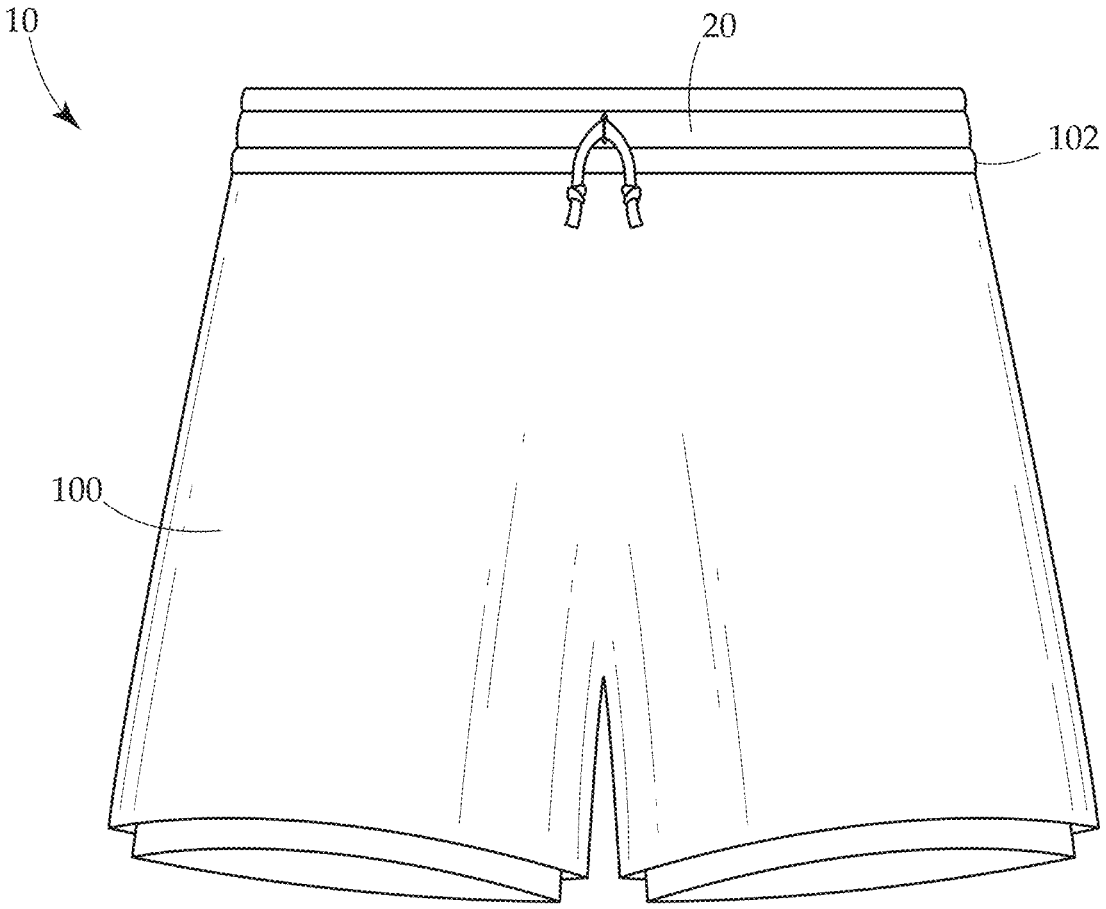
FIG. 1 is a front perspective view of an outer shell of the adjustable undergarment according to an exemplary embodiment.

FIG. 1 illustrates a preferred embodiment of an adjustable undergarment 10, wherein the adjustable undergarment 10 comprises an outer shell 100 and an inner shell 12 (see FIG. 2) coupled to a waistband 20 through a waistband stitch 102.

Figure 2:
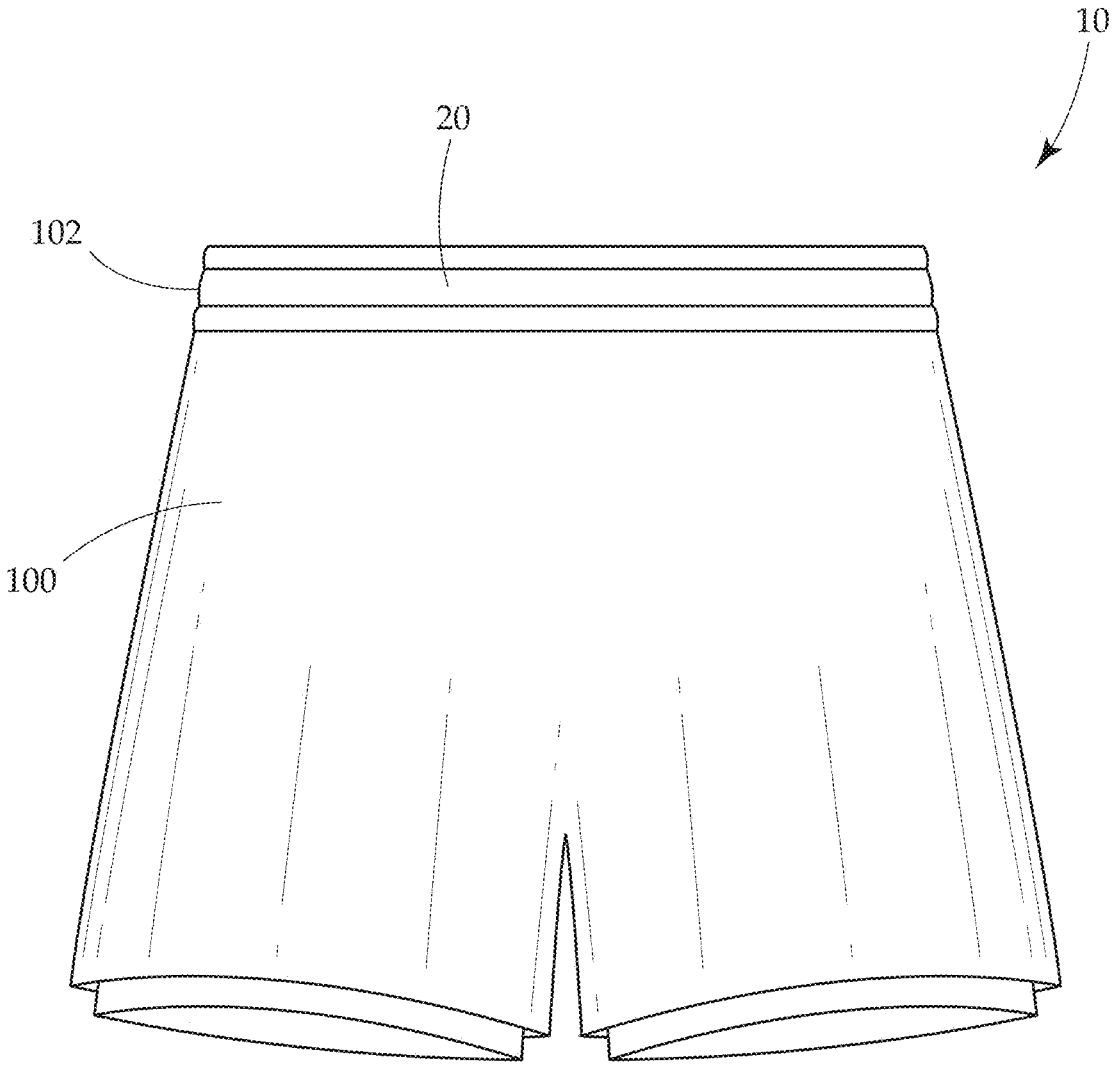
FIG. 2 is a rear perspective view of the outer shell of the adjustable undergarment according to an exemplary embodiment.

FIG. 2 illustrates a backside view of the adjustable undergarment 10 with the outer shell 100 and an inner shell 12 (see FIG. 3) coupled to the waistband 20 via the waistband stitch 102.

Referring now to FIGS. 3-6, the inner shell 12 further comprises a front panel 103 coupled to a left side panel 104 via a front left stitch 106. From there, the left side panel 104 is coupled to a rear panel 107 via a back left stitch 108. In addition, the center panel 109 couples to both the front panel 103 and the rear panel 107 via a first under stitch 110 and a second under stitch 112. Furthermore, the rear panel 107 is coupled to the right side panel 114 via a back right stitch 115. Finally, the right side panel 114 is coupled to the front panel 103 via a front right stitch 117. In alternate embodiments, the inner shell 12 may not require and/or include one or more than one of the various panel elements depending on configuration and use of the adjustable undergarment 10. In another alternate embodiment, the inner shell 12 may include a single piece of fabric or multiple pieces of fabric depending on design configuration and end usage.

Figure 3:
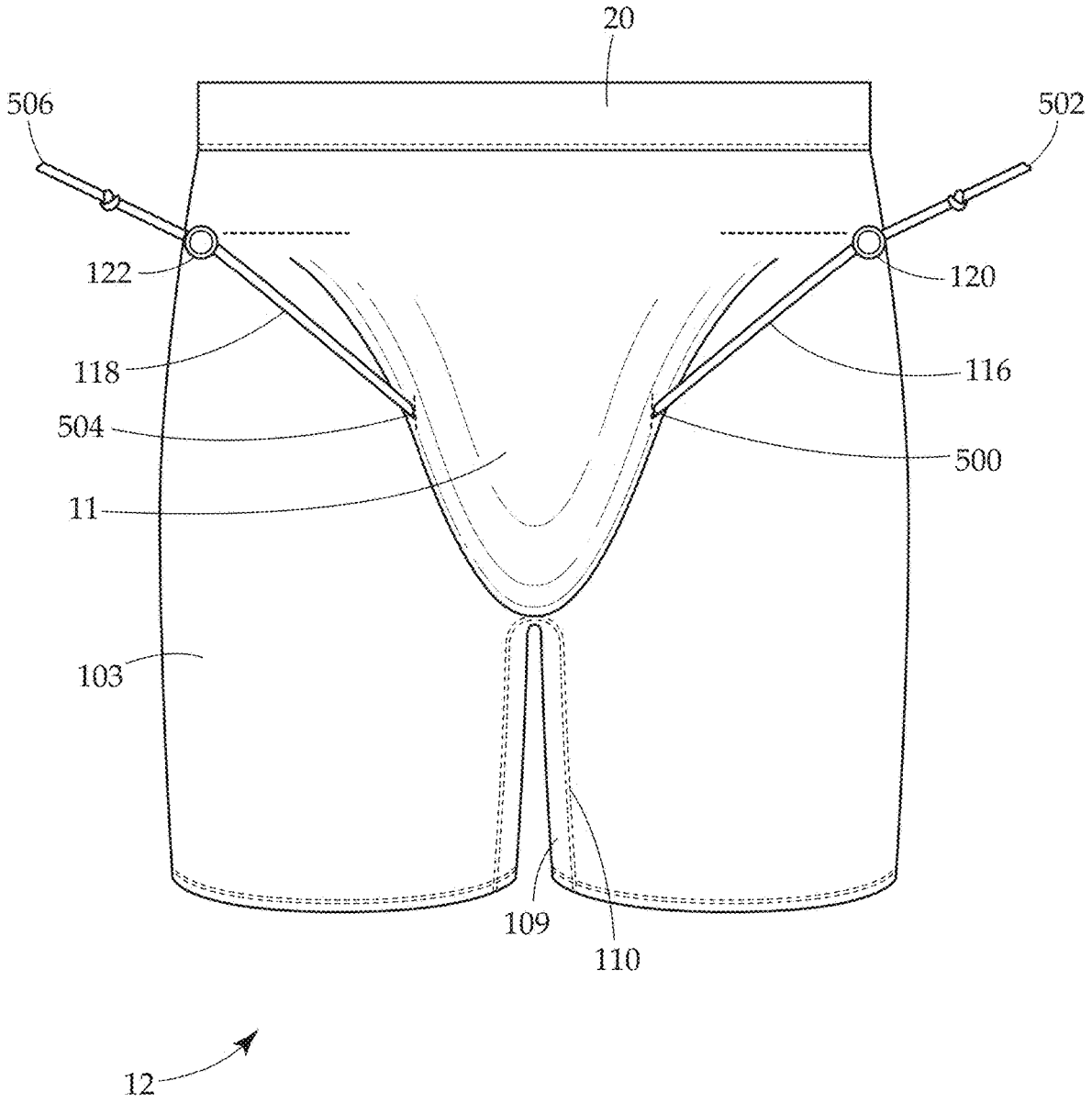
FIG. 3 is a front perspective view of an inner shell of the adjustable undergarment according to an exemplary embodiment.

FIG. 3 illustrates a front side view of the inner shell 12, wherein the present disclosure comprises a genital support pouch 11 that enables for adjustable support by a user by a pair of bungee cords, namely a right bungee cord 116 and a left bungee cord 118. Additionally, a right side toggle 120 is coupled to the right bungee cord 116, and a left side toggle 122 is coupled to the left bungee cord 118. In some embodiments, the right bungee cord 116 and the left bungee cord 118 utilize different types of pulls, including, but not limited to bungee, nylon, string, or fabric that either stretches or does not stretch. Additionally, the right bungee cord 116 comprises a first end 500 and a second end 502. Furthermore, the left bungee cord 118 comprises a first end 504 and a second end 506. Further, the right bungee cord 116 and the left bungee cord 118 may be tightened by pulling toward the hip bones of a user. The right side toggle 120 and the left side toggle 122 maintain a taunt level of the right bungee cord 116 and the left bungee cord 118 through the use of cord stop toggles being affixed to the front panel 103 underneath the waistband 20 via stitching. In some embodiments, the right side toggle 120 and the left side toggle 122 utilize hooks or Velcro®.

Figure 4:
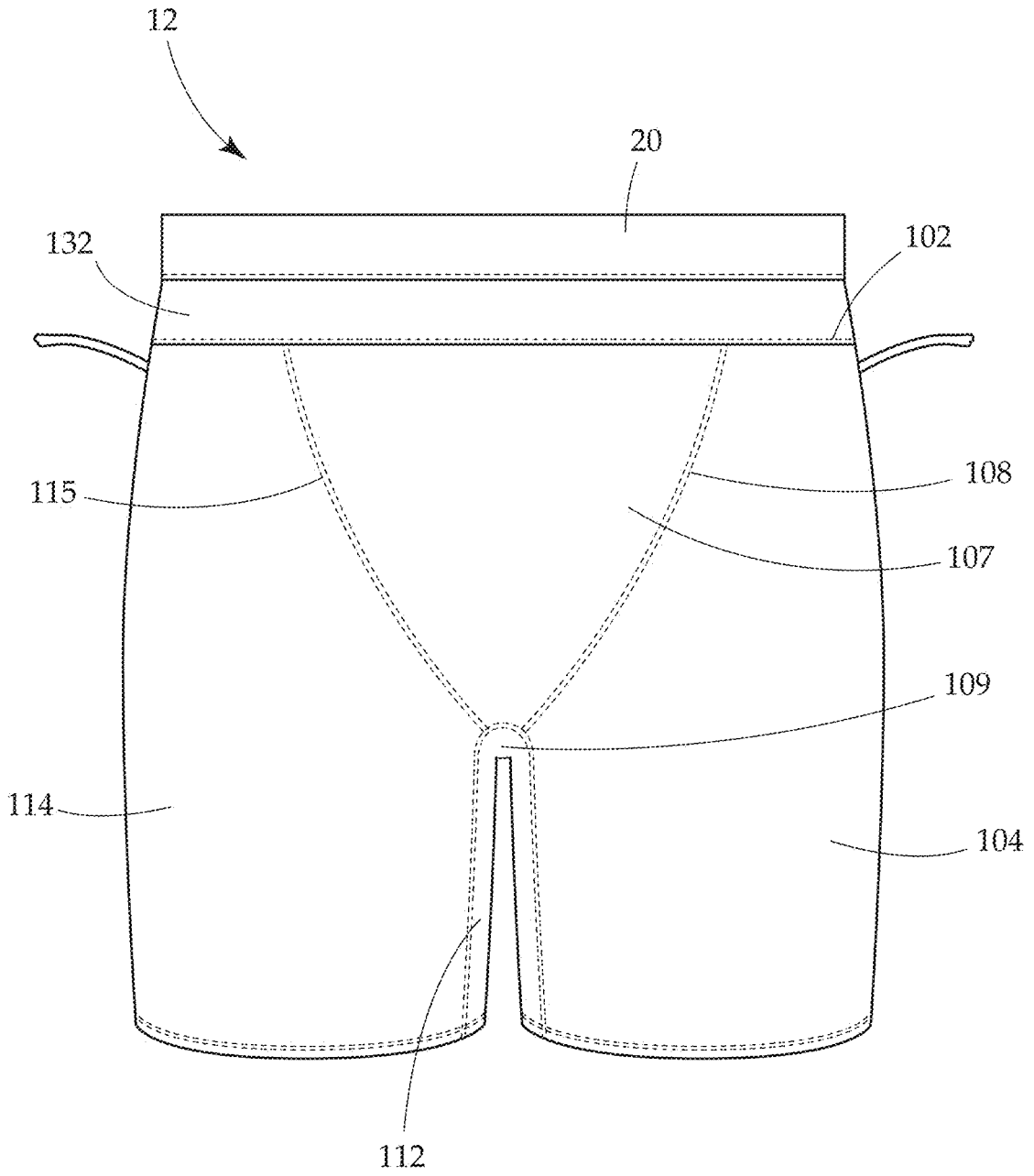
FIG. 4 is a rear perspective view of the inner shell of the adjustable undergarment according to an exemplary embodiment.
Figure 5:
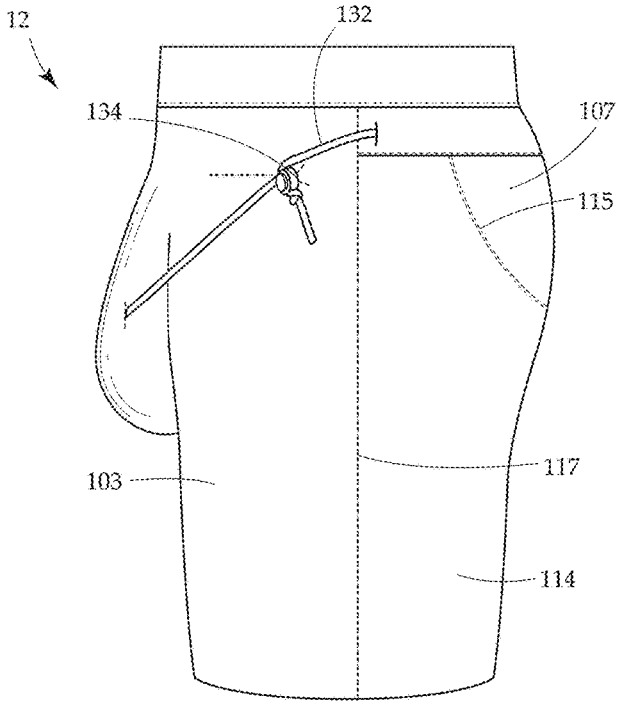
FIG. 5 is a right side perspective view of the inner shell of the adjustable undergarment, according to an exemplary embodiment.
Figure 6:
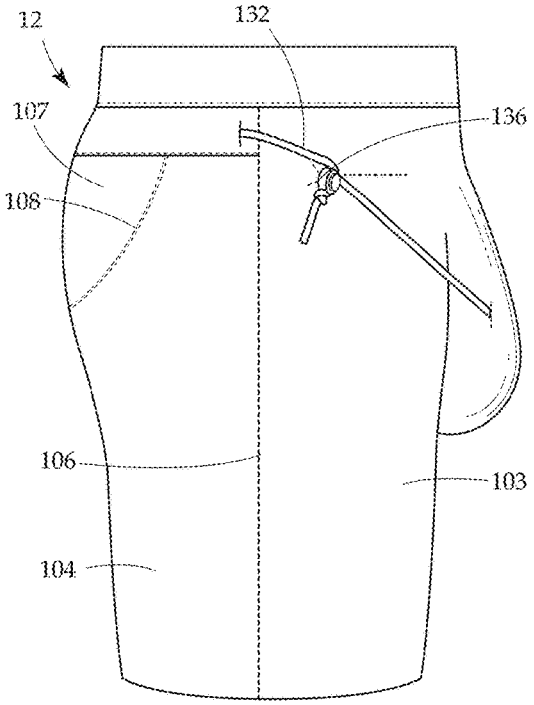
FIG. 6 is a left side perspective view of the inner shell of the adjustable undergarment, according to an exemplary embodiment.
Figure 7:
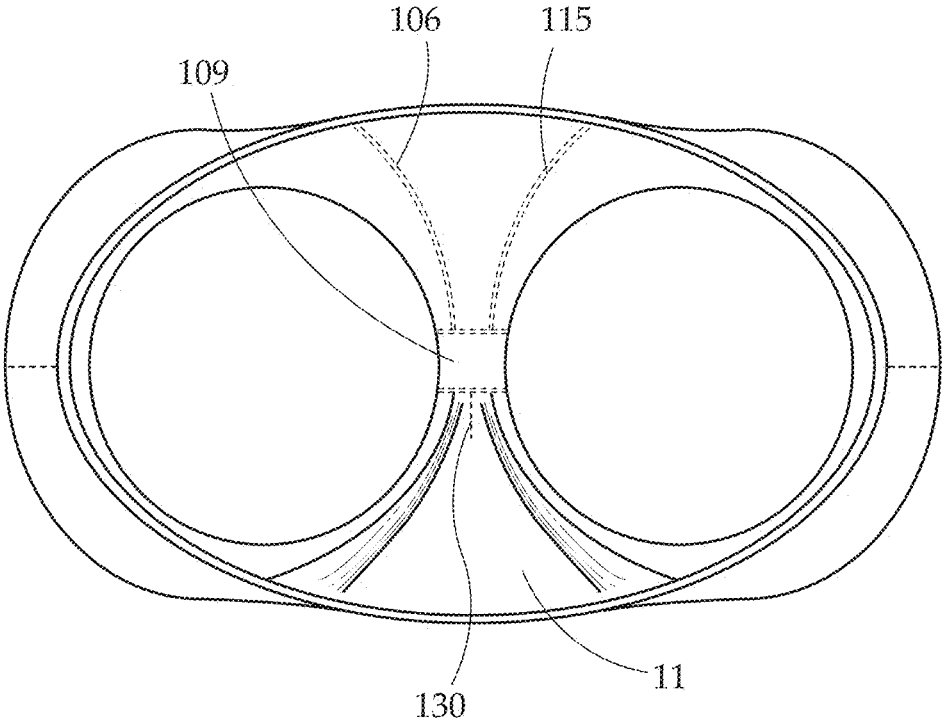
FIG. 7 is a top perspective view of the inner shell of the adjustable undergarment, according to an exemplary embodiment.
Figure 8:
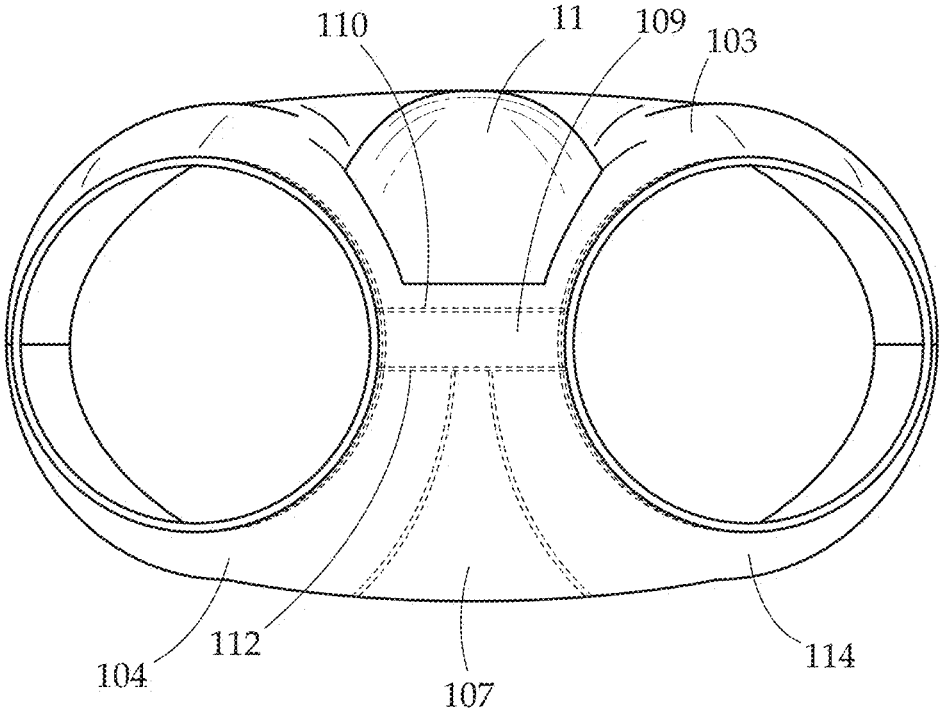
FIG. 8 is a bottom perspective view of the inner shell of the adjustable undergarment, according to an exemplary embodiment.

As shown in FIGS. 4-6, there is a non-stretch piece of material, namely a rear band 132, that wraps laterally around a length of the adjustable undergarment 10, just below the waistband 20. The rear band 132 is secured around the top side of the rear panel 107, the right side toggle 120, and the left side toggle 122. The rear band 132 allows for the support pouch 11 to move upon adjustments by the user. The preferred embodiment of the rear band 132 is a flat nylon, or any other minimal stretch fabric which allows an upper right anchor point 134 and an upper left anchor point 136 to keep tension on the left bungee cord 118 and the right bungee cord 116 while keeping the support pouch 11 at a user's desired snugness/firmness level.

Moreover, referring to FIGS. 7-11, the support pouch 11 is formed in one embodiment by taking support panel 111 (see FIGS. 9A-9B) located in the front panel 103 and folding the support panel 111 under itself to create a fold. As seen in FIG. 9C, the inner shell 12 is design to have a length of the front panel 103 be greater than the length of the rear panel 107, the left side panel 104, and the right side panel 114. Specifically, FIG. 9C shows the inner shell 12 with the support panel 111 in located at or near a top of the front panel 103.

Figure 9A:
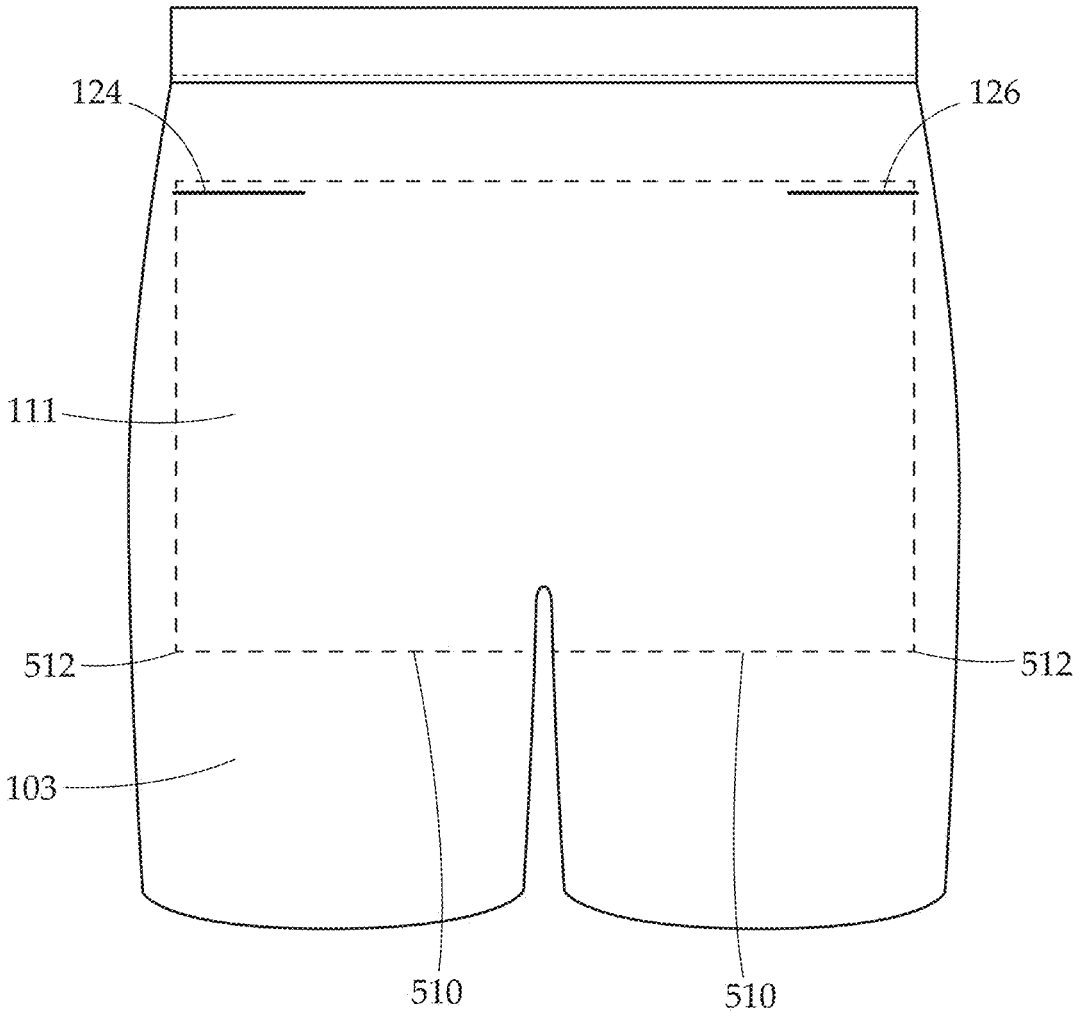
FIGS. 9A-9K are deconstructed perspective views of the steps in the formation of the support pouch by a support panel in the front panel in the inner shell of the adjustable undergarment, according to an exemplary embodiment.
Figure 9B:
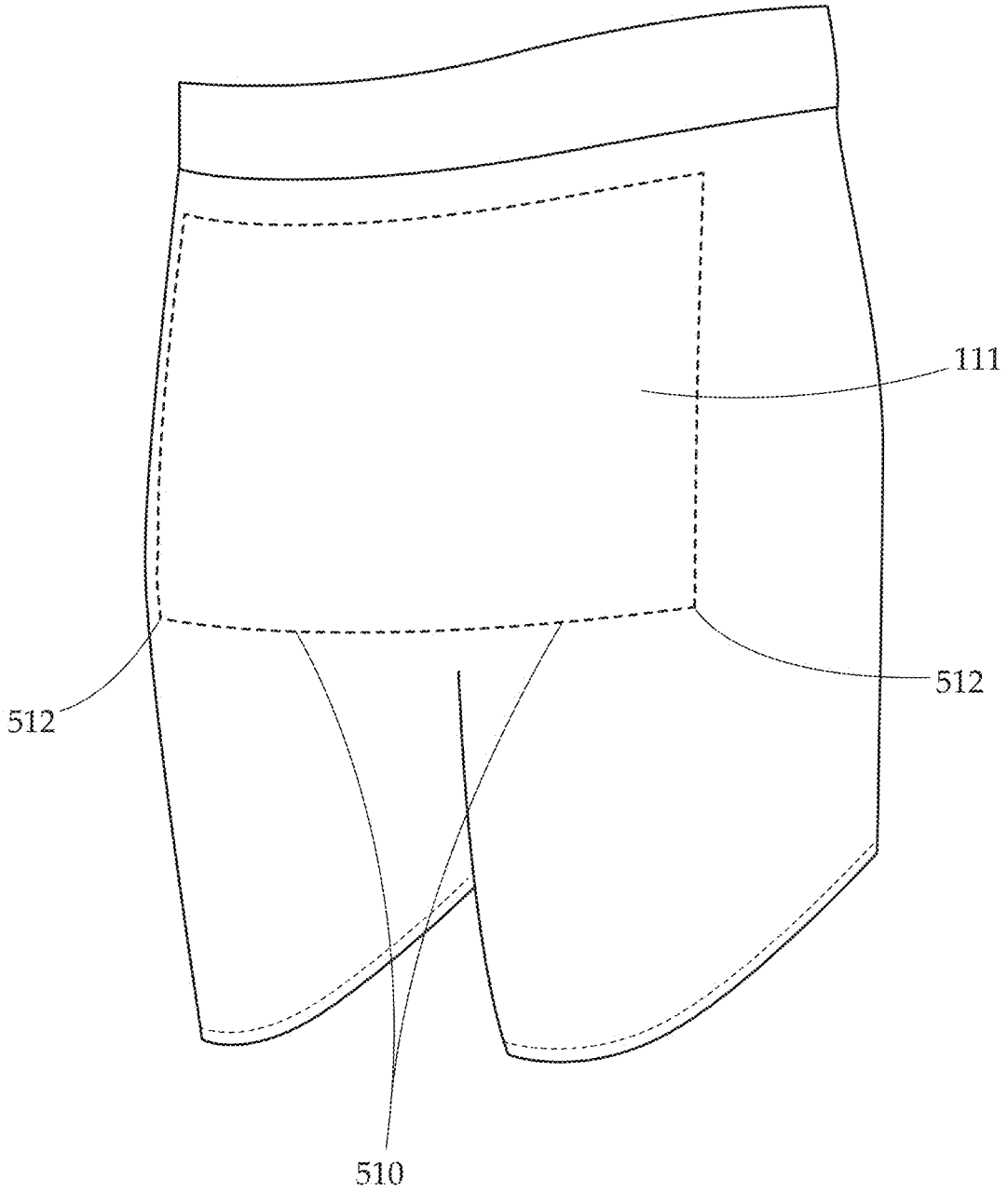
Figure 9C:
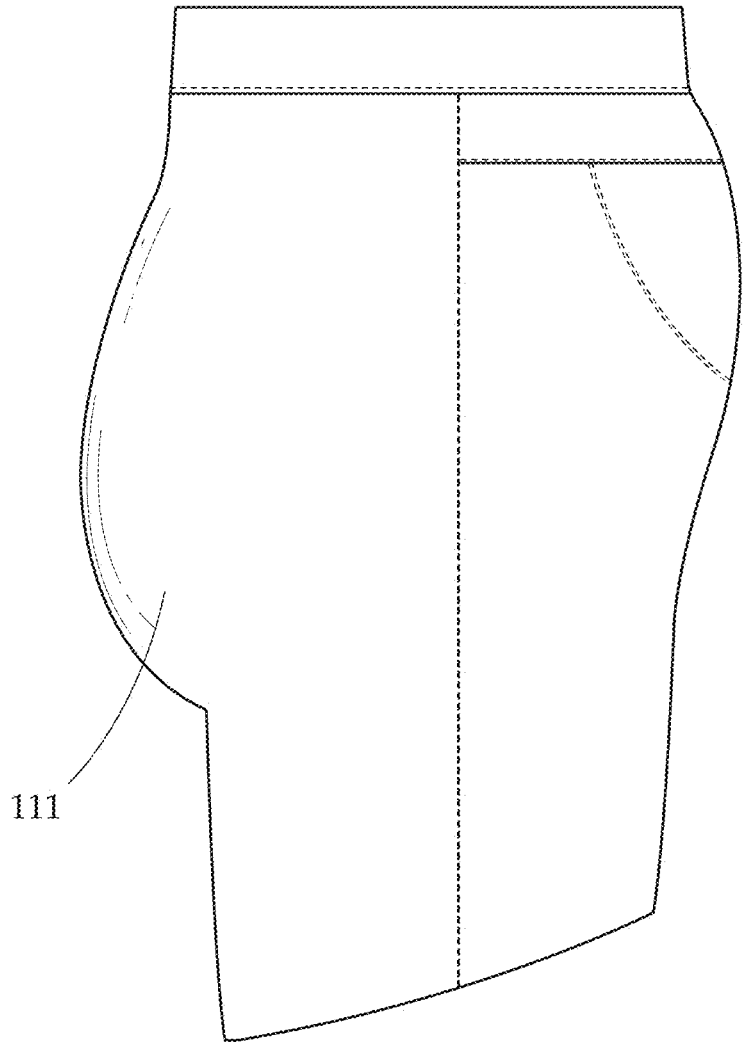
Figure 9D:
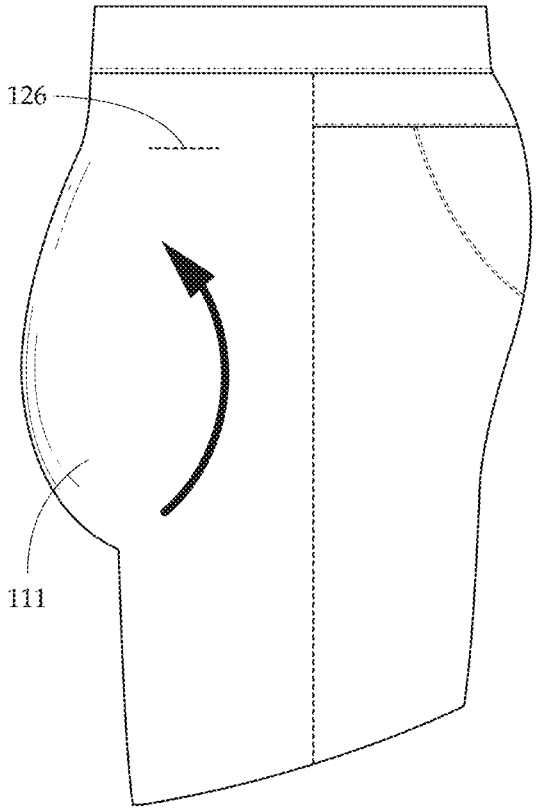
Figure 9E:
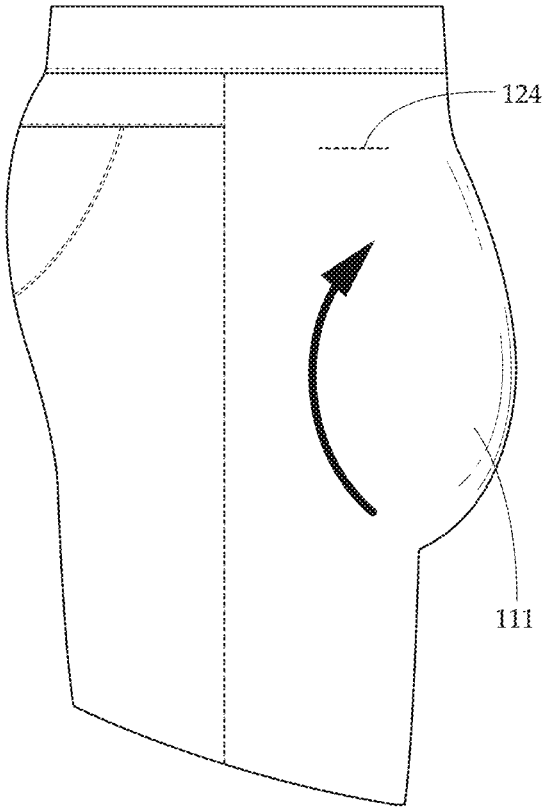
Figure 9F:
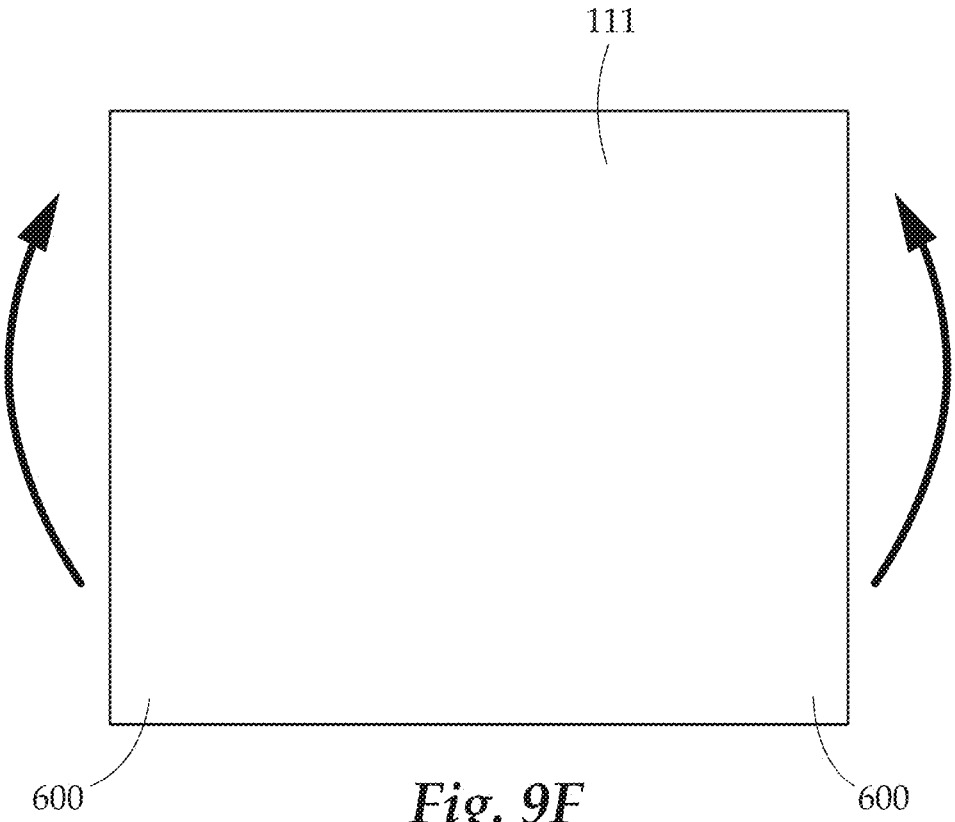
Figure 9G:
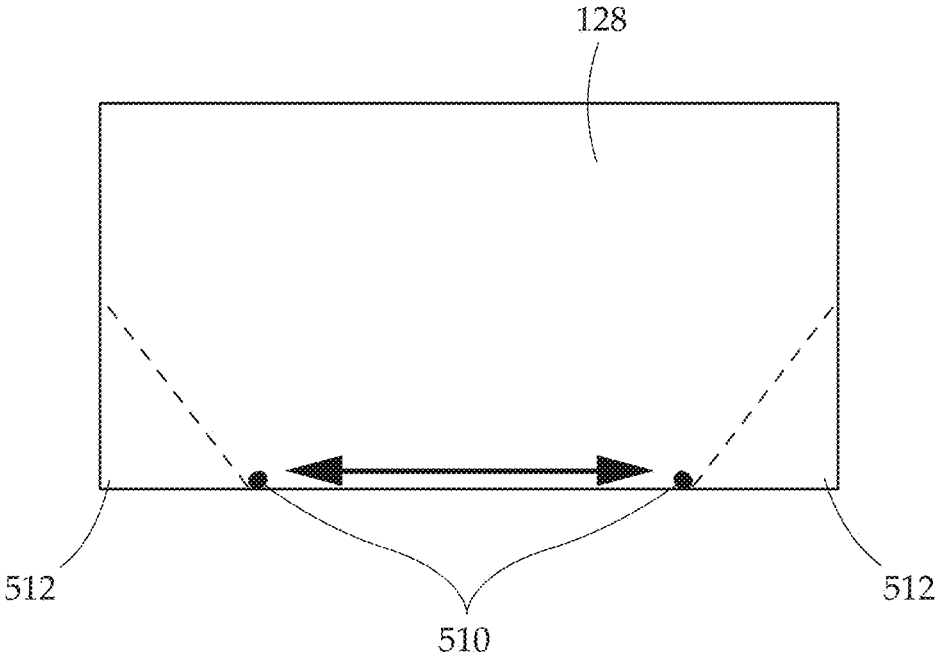
Figure 9H:
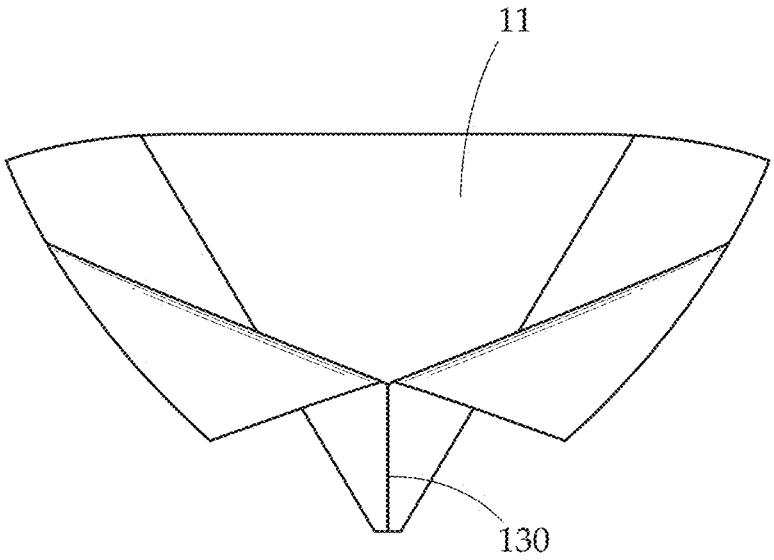
Figure 9I:
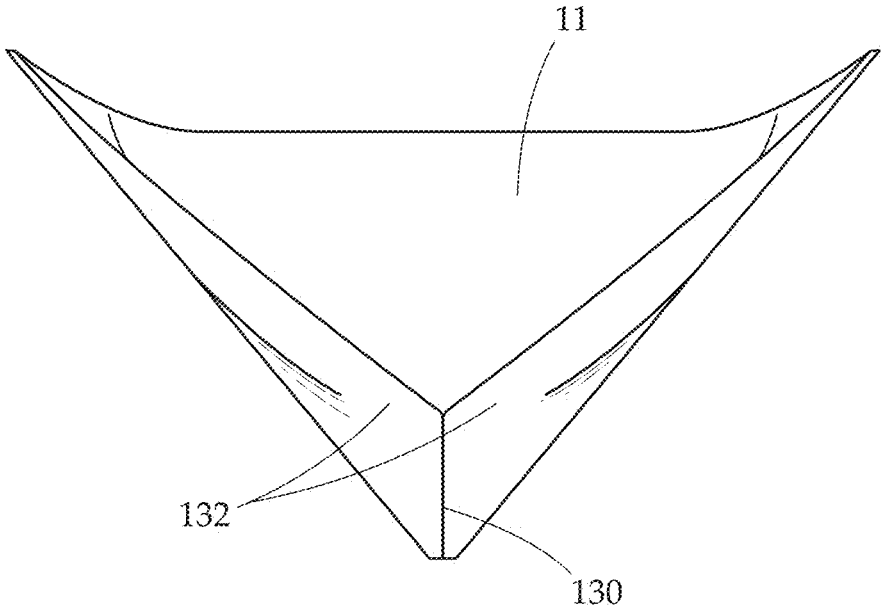
Figure 9J:
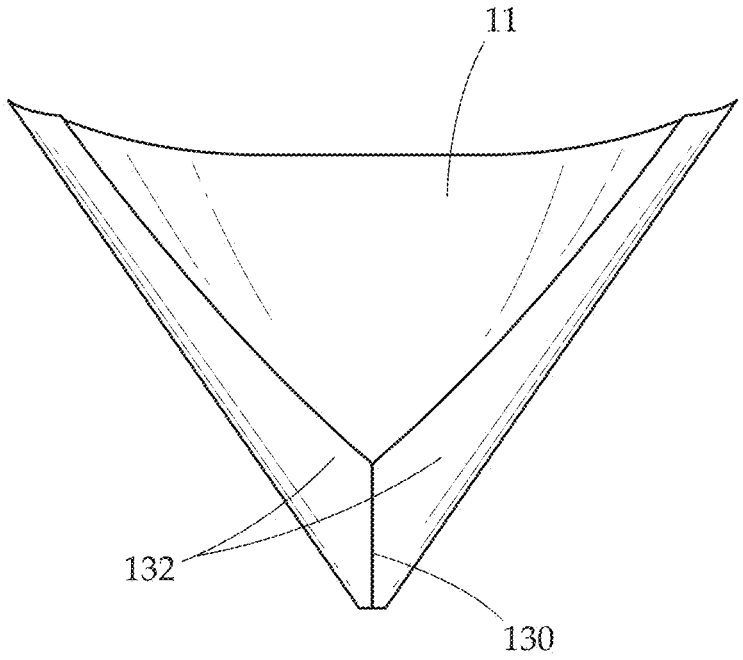
Figure 9K:
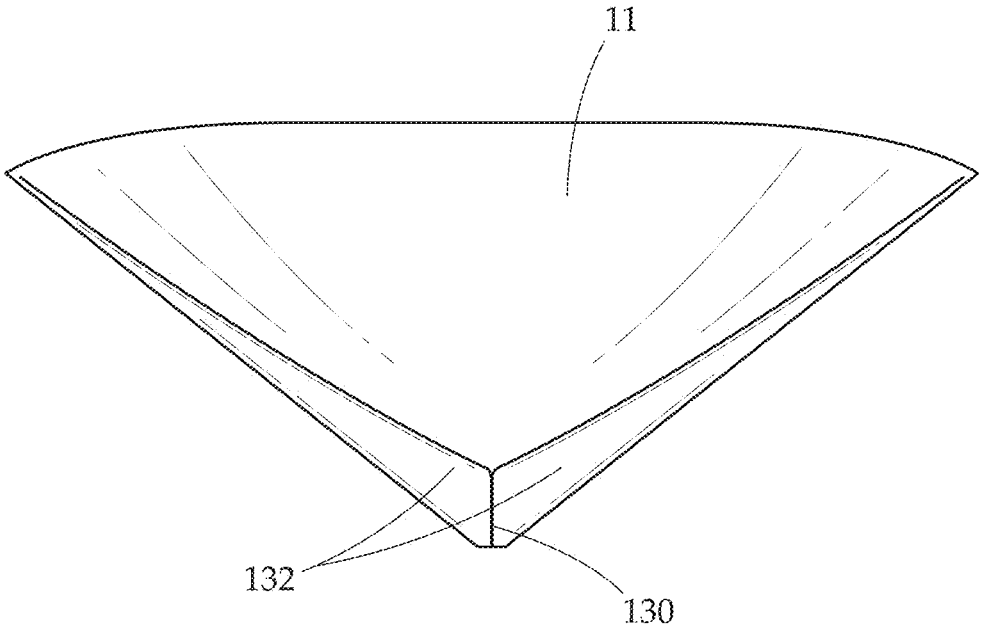

Turning now to FIG. 9F, in one embodiment, the support pouch 11 is created by the support panel 111 in the front panel 103, by first folding each bottom corner 600 of the support panel 111 up and under. Next, a left waist stitch 124 and a right waist stitch 126 (see FIG. 10) fasten a fabric fold 128 at a point near a user's groin, on each side of the groin. As a result, the front panel 103 of the inner shell 12 decreases in length to match the length of the rear panel 107, the left side panel 104, and the right side panel 114. Furthermore, FIGS. 9H-9K illustrate the nature in which each bottom corner of the fabric fold 512 is pinched together and stitched to the center panel 109 via a middle stitch 130. As a result, the support panel 111 of the front panel 103 creates the support pouch 11, which in turn the support pouch 11 keeps its shape due to the stitches 124 and 126 that are placed below the waistband 20.

The genital support pouch 11 is intended to create a barrier between the legs and genital area, stopping any skin-on-skin contact or chafing. The preferred embodiment of the adjustable undergarment 10 is a 230 GSM poly/spandex blend but can also consist of any compression type or non-compression type fabric. In some embodiments a seamless circular knit sewing machine could make the genital support pouch 11 with a 3D sewing machine. This might alleviate the need for the folds/pleats. In some embodiments, the genital support pouch 11 uses fabric glue to hold the pieces together, to achieve a seamless pouch. In some embodiments, genital support pouch 11 uses butt seams that do not have the traditional flat locks or mock seams, to hold the pieces together, to achieve a seamless pouch.

Further referring to FIG. 9-12, the bottom edges of the fabric fold 510 create an interior lips 132 of the genital support pouch 11 that blocks the genitals from escaping from the support pouch 11, separating them from contact with the body. The interior lips 132 are created by pinching the bottom corners of the fabric fold 512 together and stitching them together at the center panel 109 via an origami style fold and a middle stitch 130. The preferred embodiment has no seams that line the support pouch 11. In alternative embodiments the support pouch 11 is constructed with multiple pieces of fabric with various exterior stitching to create a seamless interior pouch. As a result, the support pouch 11 positions the genitals in a forward position in front of, and not in-between a user's legs.

Figure 10:
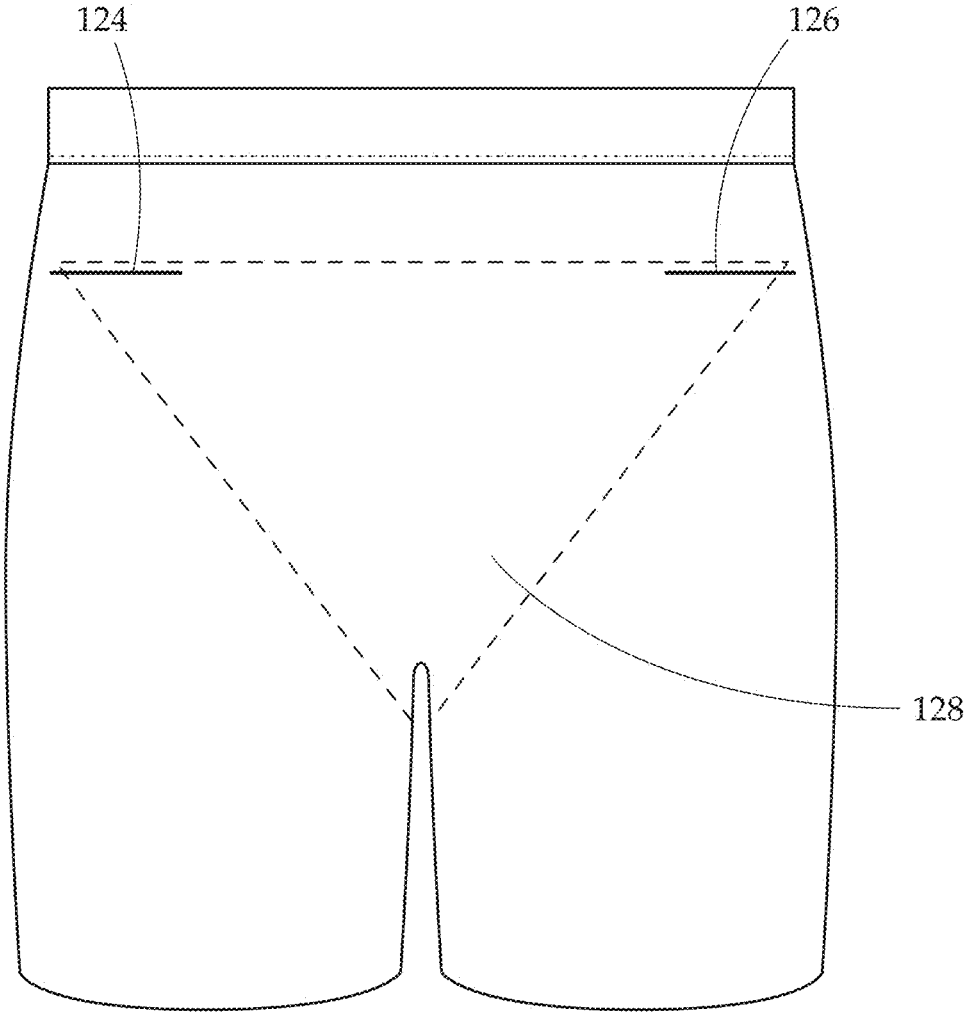
FIG. 10 is a semi-constructed perspective view of the support pouch in the adjustable undergarment, according to an exemplary embodiment.
Figure 11:
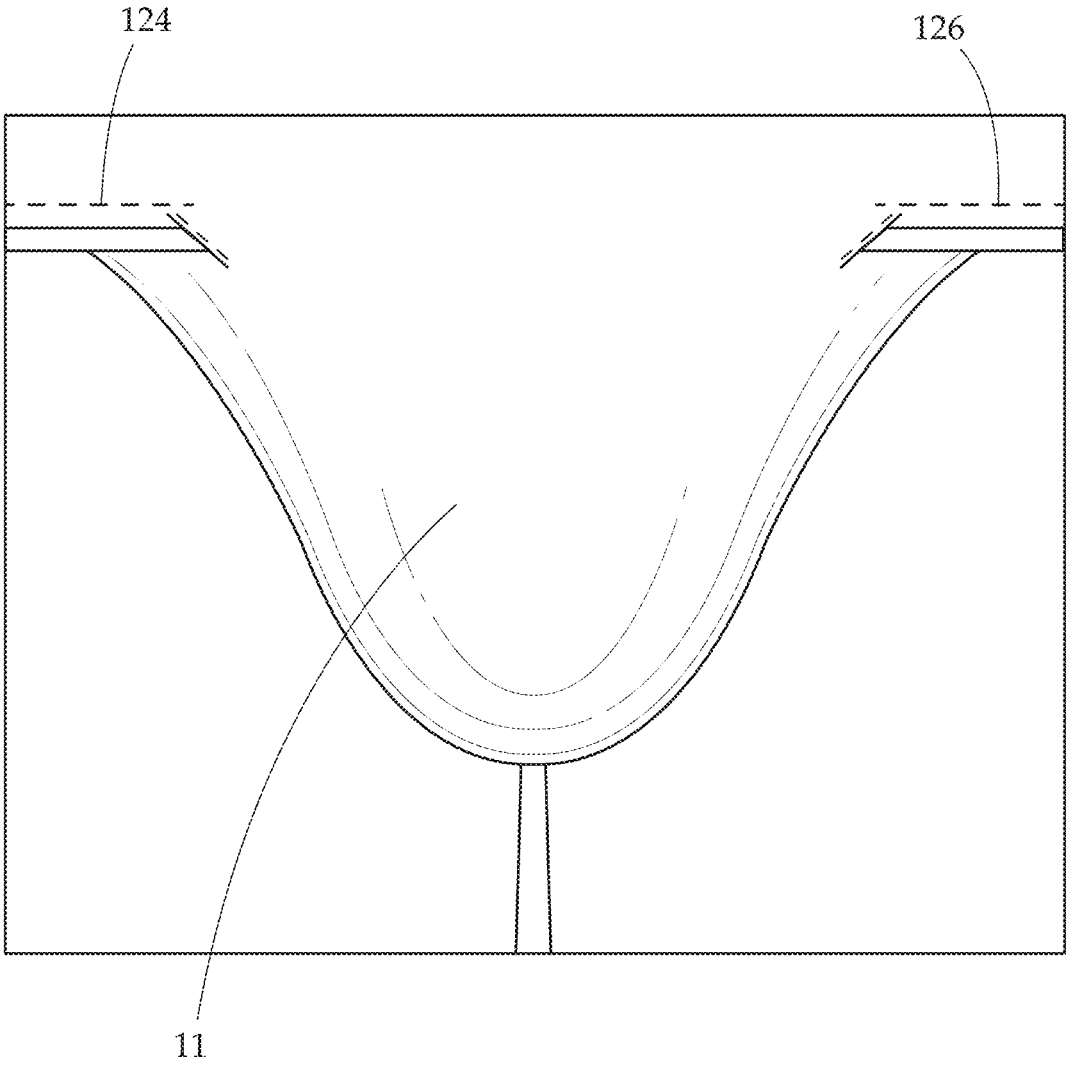
FIG. 11 is an enlarged front perspective view of the support pouch in the adjustable undergarment, according to an exemplary embodiment.
Figure 12:
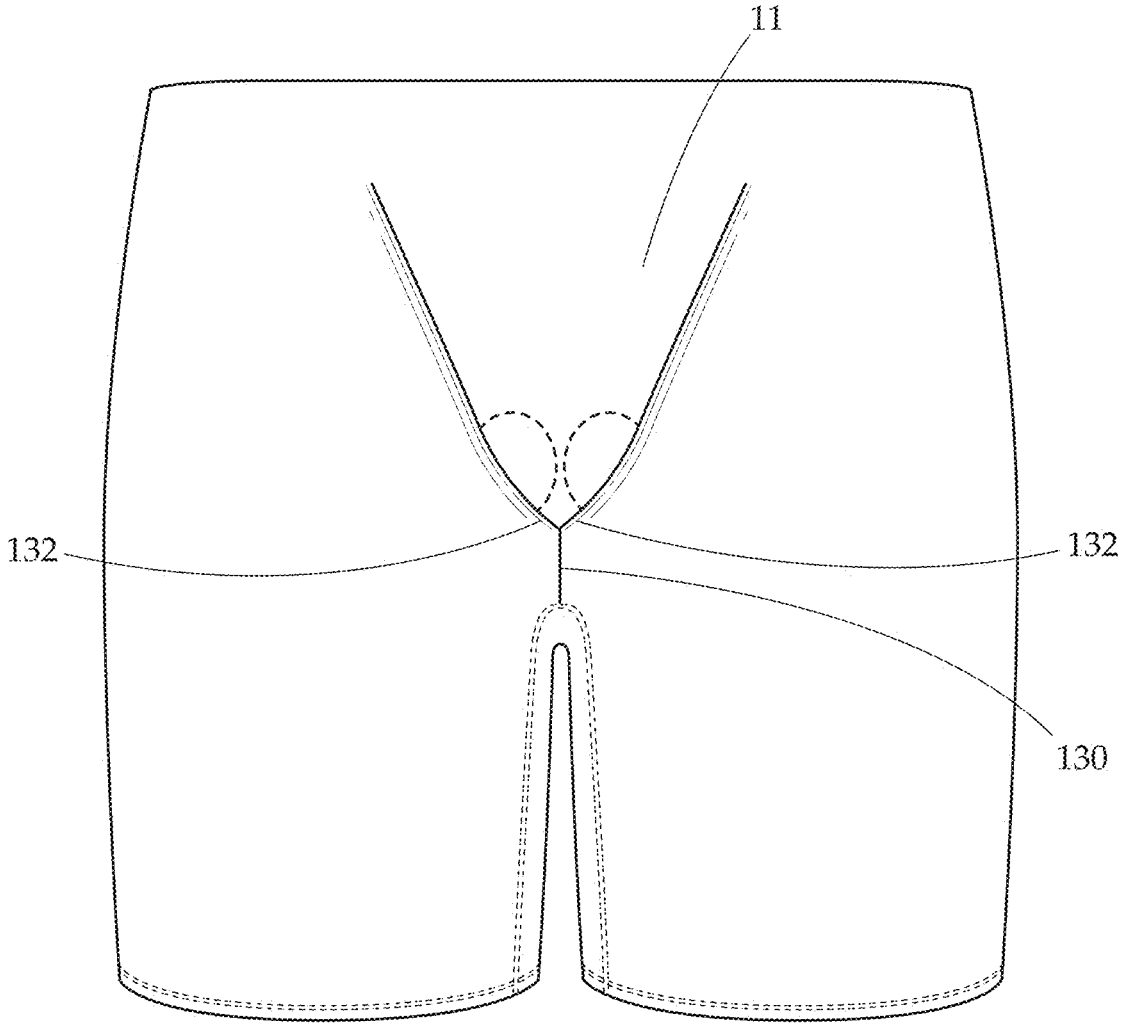
FIG. 12 is an inside-out front perspective view of the support pouch in the adjustable undergarment in use, according to an exemplary embodiment.

Furthermore, FIG. 10 displays a dotted triangular area where the support pouch 11 sits. Also, FIG. 11 shows an enlarged view of the genital support pouch 11. Moreover, FIG. 12 shows an example male genitalia sitting in the support pouch 11 and being held in place by the interior lips 132.

Figure 13:
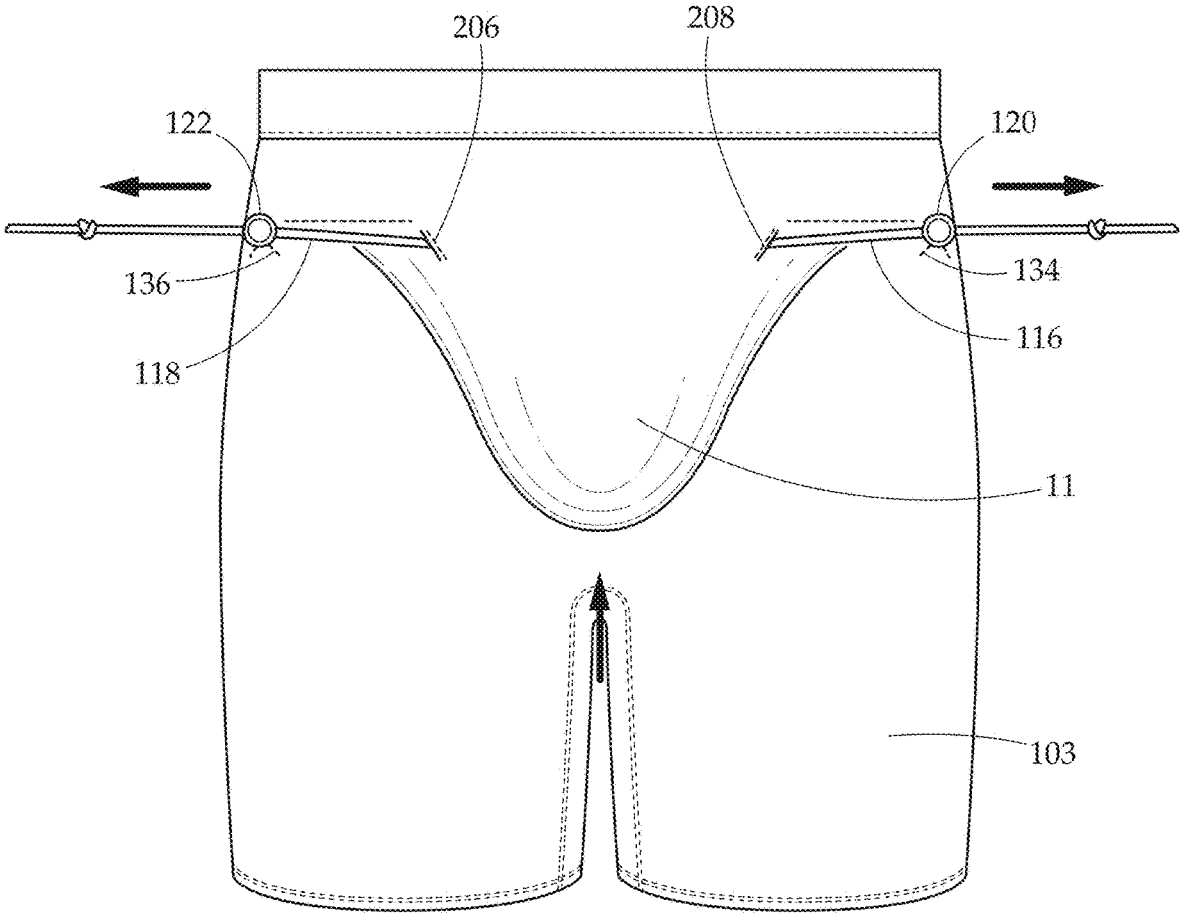
FIG. 13 is a front perspective view of the support pouch engaged in the inner liner of the adjustable undergarment in a contracted state, according to an exemplary embodiment.
Figure 14:
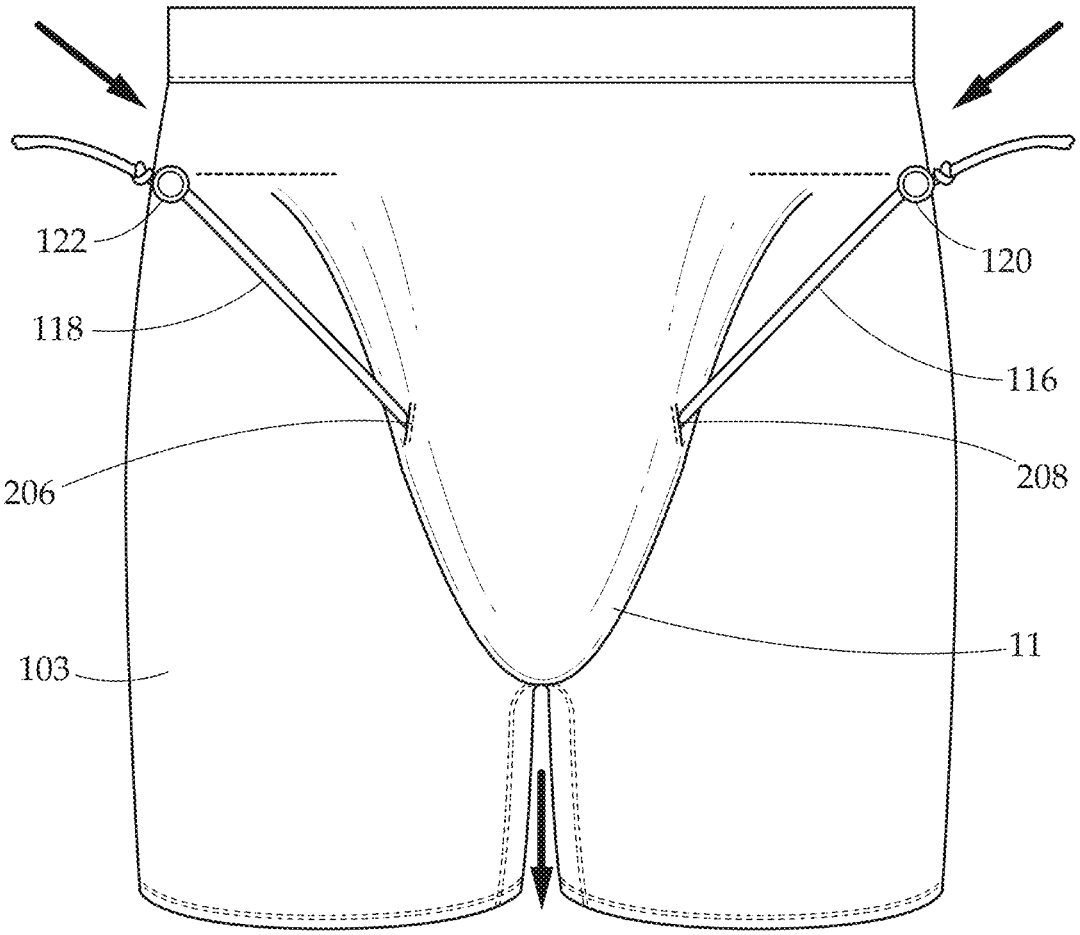
FIG. 14 is a front perspective view of the support pouch disengaged in the inner liner of the adjustable undergarment in a released state, according to an exemplary embodiment.

As shown in FIGS. 13 and 14, the support pouch 11 is engaged and disengaged by leveraging the right bungee cord 116 and the left bungee cord 118 that are connected to a left lower anchor point 206 and a right lower anchor point 208 on the support pouch 11, and a right side toggle 120 and left side toggle 122, that allows tension to be applied to the genital support pouch 11. The left lower anchor point 206 and the right lower anchor point 208 are created by preferably double stitching the right bungee cord 116 and the left bungee cord 118 into the front panel 103 on the support pouch 11. The right bungee cord 116 passes through right side toggle 120 and the left bungee cord 118 passes through left side toggle 122. Each toggle is a mechanism that enables the bungee cords to be placed at a tensioned and untensioned state. The right side toggle 120 and left side toggle 122 are secured to a rear band 132. The right side toggle 120 is secured to the rear band 132 at an upper right anchor point 134. The left side toggle 122 is secured to the rear band 132 at an upper left anchor point 136. Each anchor points holds the corresponding toggle in place so that the toggles do not drag down the front panel 103, when the support pouch 11 is in an under tensioned state. Because right bungee cord 116 is secured at right lower anchor point 208 and passes through right side toggle 120, the support pouch 11 can be raised and lowered to vary the level of support. Because left bungee cord 118 is secured at left lower anchor point 206 and passes through left side toggle 122, the support pouch 11 can be raised and lowered, perpendicular to waistband 20, to vary the level of support.

Right side toggle 120 and left side toggle 122 allow users to adjust or customize the fit of the support pouch 11 to varying levels to fit said user's shape, size and type of activity being performed. Excess bungee cord is placed at the end of the bungee cords, after they pass through their corresponding toggle, to enable the user easy access to the bungees from slits in pockets of the outer shell 100, which allows covert adjustments. The preferred embodiment of the bungee cord is of ⅛" shock bungee rubber rope cord, but any other cord can be used in place. Specifically, the outward pointing black arrows in FIG. 13 represent the bungees being pulled in a tensioned state. As a result, the upward pointing arrow represents the support pouch 11 contracts in order to accommodate users, perpendicular to waistband 20. Furthermore, the inward pointing black arrows in FIG. 14 represent the bungees being released to an un-tensioned state. As a result, the downward pointing arrow represents the direction the support pouch 11 releases in order to accommodate users, perpendicular to the waistband 20.

The right side toggle 120 and left side toggle 122 are comprised of a sleeve, an upper piece, and a spring. There is a hole in both the sleeve and a hole in the upper piece, that each bungee cord passes through. Tied knots keep each bungee cord from exiting each toggle. When pressure is applied to the upper piece, the two holes line up so that the bungee cord can pass through, freely. When pressure is released from the upper piece, the spring forces the upper piece away from the sleeve and the holes separate, causing tension on the bungee cord and causing them to stay in a fixed position. This type of toggle is the preferred embodiment, but many other ways can be utilized, including knots, manual cord locks and any other mechanism that creates both a tensioned and un-tensioned state.

The method for putting on the adjustable undergarment 10 is to have the left bungee cord 118, the right bungee cord 116, the right side toggle 120, and the left side toggle 122 at an un-tensioned state. The user slides their legs through each pant leg and pulls the undergarment up around their waste. The genitals are held within the support pouch 11 as the undergarment is pulled up. Once the user is comfortable with how the undergarment is positioned, they can apply tension to the bungee cords and keep said tension with the toggles. This, in turn, elevates the support pouch 11 and constricts the shape/size of the support pouch 11 to create optimal support for different users.

The preferred use of the adjustable undergarment is of athletic activity. The undergarment utilizes the toggle support system to stabilize and firmly secure male genitalia in order to stop chafing, all while preventing uncomfortable fitness sessions, as a result. In some embodiments, the undergarment is paired with an outer short to make a two-layer running short. In some embodiments, the undergarment is utilized by itself when made from a thicker material, like 300, or greater GSM.

In some embodiments, the adjustable undergarment 10 is built into a pair of pants. In some embodiments, the adjustable undergarment 10 is built into knee length tights. In some embodiments, undergarment 10 is added with the bungee cords and toggles to shorts that have the traditional pouch with seams.

Although the invention has been explained in relation to its preferred embodiment, it is understood that many other possible modifications and variations can be created without departing from the spirit or scope of the invention as hereinafter claimed.

What is claimed is:

1. An adjustable undergarment comprising:
an inner shell, comprises:
a front panel;
a left side panel;
a right side panel;
a center panel;
a rear panel;
a support pouch integrated within the front panel comprising:
a middle stitch;
a left waist stitch; and
a right waist stitch,
a right side bungee cord positioned laterally to the genital support pouch comprising:
a first end fastened to the genital support pouch; and
a second end that passes through a right side toggle,
a left side bungee cord positioned laterally to the genital support pouch comprising:
a first end fastened to the genital support pouch; and
a second end that passes through a left side toggle; and
a rear band positioned dorsally to the genital support pouch comprising:
a left end that passes through the left side toggle;
a right end that passes through the right side toggle; and
wherein the genital support pouch is seamless within the front panel.

2. The adjustable undergarment of claim 1, wherein when the left and right side toggles are engaged, the support pouch is tightened around a user's genitals by moving in an upward direction towards a waistband.

3. The adjustable undergarment of claim 1, wherein the support pouch is formed when a support panel of the front panel of the inner shell is folded inwards and fastened together via the middle stitch.

4. The adjustable undergarment of claim 1, wherein the support pouch further comprises an interior lip that is formed by pinching each of the bottom corners of an extra fabric of the front panel together and stitching the pair of the bottom corners of the extra fabric together at the center panel via the middle stitch.

5. The adjustable undergarment of claim 1, wherein the support pouch configured to position a user's genitals in a forward position in front of a user's legs.

6. The adjustable undergarment of claim 1, wherein the first end of the left bungee cord is fastened to a lower left anchor point on the support pouch via a stitch, and the first end of the right bungee cord is fastened to a lower right anchor point on the support pouch via a stitch.

7. The adjustable undergarment of claim 1, wherein the support pouch constricts in a proximal manner when the left bungee cord and right bungee cord are engaged and pulled outwardly.

8. The adjustable undergarment of claim 1, wherein the support pouch remains constricted in a proximal manner when the second end of the left bungee cord is held in place by the left toggle and the second end of the right bungee cord is held in place by the right toggle after they are pulled outwardly.

9. The adjustable undergarment of claim 1, wherein the support pouch disengages in a distal manner when the left bungee cord and the right bungee cord are released.

10. The adjustable undergarment of claim 1, wherein the support pouch stays released in a distal manner when the second end of the left bungee cord is loosened from the left toggle and the second end of the right bungee cord is loosened from the right toggle.

11. The adjustable undergarment of claim 1 further comprising an outer shell, wherein the inner shell and outer shell are coupled together via the waistband.

* * * * *